United States Patent [19]

Duina

[11] Patent Number: 4,643,634

[45] Date of Patent: Feb. 17, 1987

[54] WORK PIECE TRANSPORTING APPARATUS

[75] Inventor: Franco G. Duina, Glenview, Ill.

[73] Assignee: F. J. Littell Machine Co., Chicago, Ill.

[21] Appl. No.: 522,657

[22] Filed: Aug. 12, 1983

[51] Int. Cl.[4] ..... B23Q 7/04

[52] U.S. Cl. ..... 414/749; 414/751; 414/737; 74/102; 901/48

[58] Field of Search ..... 901/14, 15, 23, 45, 901/48; 414/749, 750, 751, 752, 753, 737; 74/102, 103

[56] References Cited

U.S. PATENT DOCUMENTS

| | | | |
|---|---|---|---|
| 3,561,614 | 2/1971 | Tezuka et al. | 414/751 |
| 3,902,606 | 9/1975 | Ronbeck | 414/737 X |
| 4,229,136 | 10/1980 | Panissidi | 901/48 X |
| 4,295,780 | 10/1981 | Wada et al. | 414/749 |
| 4,299,533 | 11/1981 | Ohnaka | 414/752 |
| 4,400,984 | 8/1983 | Ronbeck | 414/749 X |
| 4,441,852 | 4/1984 | Dixon | 414/753 |

*Primary Examiner*—Terrance L. Siemens
*Attorney, Agent, or Firm*—McDougall, Hersh & Scott

[57] ABSTRACT

A handling apparatus for work pieces such as sheet metal pieces which are to be formed in a sheet metal press. The handling apparatus is designed to pick up a work piece from a first location which may comprise a stack of sheets, and to then move the work piece to a second location which may comprise the tool of the forming press. In the course of movement, the work piece will generally travel laterally, however, a vertical component of movement is imposed in at least one location, for example, when placing the work piece in position at the forming station. The drive means for moving the gripping means comprises a driver and a first shaft supporting a primary arm. A connection is provided between the first shaft and the driver so that the driver oscillates the primary arm. A pivoting follower is also associated with the driver so that movement of the driver simultaneously controls movement of the follower. The primary arm is connected to a secondary arm so that the oscillating movement of the primary arm will move the secondary arm and its associated gripper along a generally lateral path of movement. The follower is also connected to the secondary arm, and movement of the follower applies an additional driving influence to the secondary arm simultaneously with the driving influence imparted to that arm by the primary arm.

35 Claims, 15 Drawing Figures

92
94

51
52
58
59
54
56
60
62
82

86
54
56
84

34
32
30

18
22

86
54
56
84

34
30
32

18
22

86
84
56
54

34
30
32

18
22

WORK PIECE TRANSPORTING APPARATUS

BACKGROUND OF THE INVENTION

This invention relates to a work piece transporting apparatus which may be employed, for example, in conjunction with a sheet metal forming press. In the usual operation of such a press, a work piece comprised of sheet metal is located at a forming station comprising a tool or die. The press is operated to form the sheet into the desired shape, and the formed work piece is then removed, and the next work piece located in position at the forming station.

Various attempts have been made to provide automatic means for transporting work pieces to the work station of a forming press or to work stations of other types of machinery. Such prior means include the apparatus disclosed in Ronbeck U.S. Pat. No. 3,902,606 issued on Sept. 2, 1975. In this apparatus, a gripping means for holding a sheet metal plate is attached at the lower end of a pivoting rod. The upper end of the rod carries a cam follower, and a cam path is defined adjacent this upper end whereby the gripping means can be moved along a path generally in the shape of an inverted U.

The path of movement as described in the foregoing patent permits use of the gripping means for picking up sheet metal pieces at a first station and then transporting of the pieces laterally to a position above the tool of a forming press. A vertical downward component of movement then serves to locate the work piece in position relative to the tool.

The gripping means of the patented structure is moved away during the forming operation and is then returned for picking up the work piece after forming, and for then laterally transporting the work piece away from the press.

In alternative arrangements utilizing systems of the type described in the aforementioned patent, a first gripping means may be employed for moving work pieces from a first station to the forming station. A second apparatus, located for example on the opposite side of the press, is them employed for picking up the formed piece and delivering the piece to a collection point. By utilizing separate machines for feeding and removing the work pieces, the forming operation can be carried out in a rapid and efficient manner.

All or portions of systems of the general type contemplated by this invention are also described in Italian Pat. No. 950,545 and in U.S. Pat. Nos. 2,867,185; 3,061,118; 3,091,347 3,404,789; 3,728,597; 4,056,198; 4,065,001; and 4,299,533.

There are several advantages to such systems in addition to the high production rates which can be achieved. For example, such systems are much safer to operate since it is not necessary for an operator to regularly place his hands in the forming press as is the case with manually fed machines. An apparatus of the general type is also advantageous from the standpoint of uniformity in the products made since reliable handling equipment will locate work pieces in precisely the same position for each forming operation.

Problems do arise where such equipment must handle work pieces having irregular dimensions and/or where the press tool is such that rather precise location of a work piece is required in order to achieve a proper forming operation. It has been found that complex and expensive mechanisms must be employed for transporting work pieces to and from forming presses in such cases. The complexity and expense is particularly problematical where the work piece transporting apparatus must carry a work piece laterally into position relative to a press tool, and must then descend with a substantially vertical component of movement to insure accurate positioning of the work piece relative to the tool prior to forming.

SUMMARY OF THE INVENTION

The work piece transporting apparatus of the invention is of the general type having a gripping means adapted to pick up and move work pieces from one location to another. The path of movement generally includes a transverse component of movement and a vertical component of movement at at least one end of the transverse component. In this connection, the terms "transverse" and "vertical" are utilized to indicate a path of movement having a distinct change in direction, such as a 90° change. It will be understood, however, that the terms are not used to designate any precise direction of movement, and should be construed, for example, to include a path of movement wherein a generally upward path would comprise the major component of movement with a sidewise movement being achieved at at least one end of the path.

The apparatus of the invention employs a primary arm which is driven so as to oscillate back and forth. This oscillating movement may be achieved by means of a slide or other reciprocating means which is driven back and forth and which carries a drive chain for a sprocket connected to a shaft supporting the primary arm. Thus, the reciprocating movement of the slide will achieve the oscillating of the primary arm.

A second shaft is mounted at the opposite end of the primary arm, and a secondary arm is secured to a sleeve positioned around this second shaft. By means of connecting gearing or the like, the oscillating movement of the primary arm continuously influences the movement of the secondary arm; the oscillating movement of the primary arm will, in particular, impart a transverse movement to the end of the secondary arm opposite the end mounted around the second shaft.

The invention further includes the provision of a cam follower or the like having its movement controlled by a cam track defined by the slide or other reciprocating drive means. This cam follower is connected to the secondary arm through the connecting gearing and is adapted to achieve movement of the secondary arm relative to the primary arm interdependently of and simultaneously with the movement of the primary arm. By appropriate design of the cam surfaces which are followed by the cam follower, this interdependent and simultaneous movement of the secondary arm influences the path of movement as controlled by the primary arm to thereby achieve, for example, a vertical component of movement.

The interdependent movement is particularly advantageous since it provides means for achieving a gradual, programmed, change in direction for a work-piece support thereby eliminating unwanted forces. Abrupt starting and stopping and/or rapid accelerations and decelerations can lead to vibration, to work-piece disengagement or displacement, and to other problems which effect over-all efficiency. The system of this invention substantially eliminates such problems.

DETAILED DESCRIPTION

Figure 1:
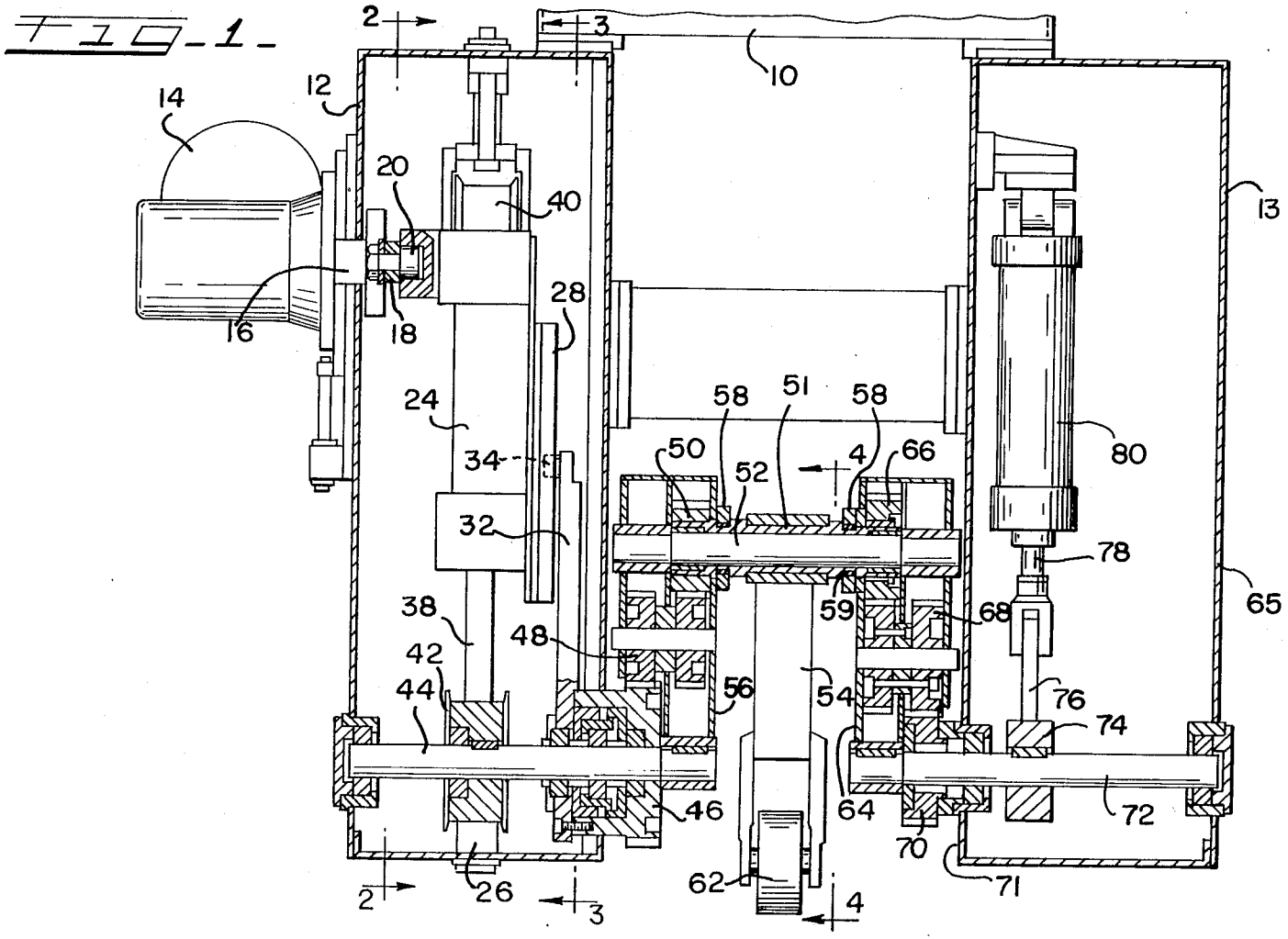
FIG. 1 is a vertical, sectional elevation of a work piece handling apparatus of the type contemplated by the invention.

An apparatus incorporating the features of the invention is shown in FIGS. 1 through 4. This apparatus comprises a frame 10 (which may be supported on a press frame) and separate housings 12 and 13 supported on the frame 10. A drive motor 14 is positioned on a side wall of one housing, and suitable gears connected to the motor rotate the shaft 16. This shaft in turn operates to rotate crank 18.

Roller 20 carried at the end of the crank rides in a slot 22 defined at the upper end of a slide 24. The slide is supported on vertical rods 26, and it will be appreciated that the slide reciprocates up and down through one cycle of movement for each revolution of the crank.

Figure 3:
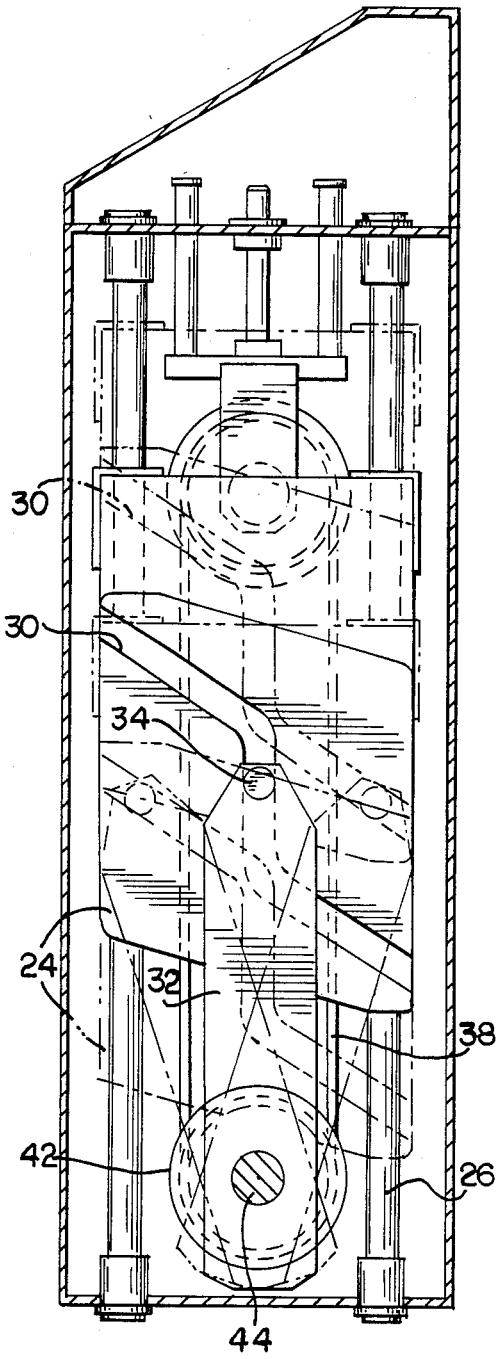
FIG. 3 is a cross-sectional view of the apparatus taken about the line 3—3 of FIG. 1.

The slide 24 carries a plate 28 which defines cam track 30. A cam follower arm 32 carries a roller 34 movable in the cam track. As the slide 24 reciprocates up and down, the cam follower is maintained in a stationary vertical posion for as long as the roller 34 is received in the vertical section of the cam track. When the roller is received in one or the other of the angularly disposed sections of the cam track, the follower pivots to one side of the other as shown in FIG. 3.

The slide 24 also supports a clamp mechanism 36 which is clamped to the drive belt 38. This belt extends around an upper sprocket 40 and a lower sprocket 42, and the belt is driven back and forth as the slide 24 moves up and down.

The sprocket 42 is tied to shaft 44, and this shaft extends through gear 46 but is not attached to this gear. The gear 46 is intstead tied to cam follower arm 32, and a gear pair 48 is driven in response to rotation of gear 46. Gear 50 connected to the gear pair is tied to sleeve 51 which is mounted on bearings around the shaft 52. The sleeve 51 is, in turn, tied to a secondary arm 54 in the apparatus.

The shaft 44 is tied to arm 56 which serves as the primary arm in the system while also serving as a housing for the gears 46, 48 and 50. The movement of the primary arm is controlled exclusively by the shaft 44, and this primary arm 56 therefore pivots back and forth as the shaft 44 oscillates in response to movement of slide 24 and belt 38. The shaft 52 supporting secondary arm 54 moves back and forth as it is carried by the arm 56.

The movement of the secondary arm 54 which is influenced by the primary arm 56, is thus achieved by rotation of shaft 44, and the relative degree of movement is controlled by the ratio of gears at 46 and 50. As will be explained, this ratio will generally be in the order of 2:1, with the actual ratio depending on other factors including the relative lengths of the arms. Typically, the angle which the primary arm moves in respect to a vertical line will be approximately one-half the angle of movement of the secondary arm in respect to the primary arm.

It will be noted that the shaft 52 extends beyond secondary arm 54 to an auxiliary arm 64 having a gear train supported therein. This gear train comprises gear 66 rotatably supported on sleeve 59, a gear pair 68, and finally gear 70 which is fixed to the wall 71 of housing 13, and which rotatably receives shaft 72. The shaft 72 is supported for rotation relative to the opposite wall 65 of housing 13, and also supports a clamp 74 connected to a lever 76. This lever is coupled to the rod 78 of cylinder 80, this rod and cylinder acting in the system to counterbalance the weight of the moving arms and other components. The cylinder may, for example, be connected to an air supply and act as a spring which can be adjusted to develop a controlled force that balances the weight of the arms and other components.

Figures 4, 8:
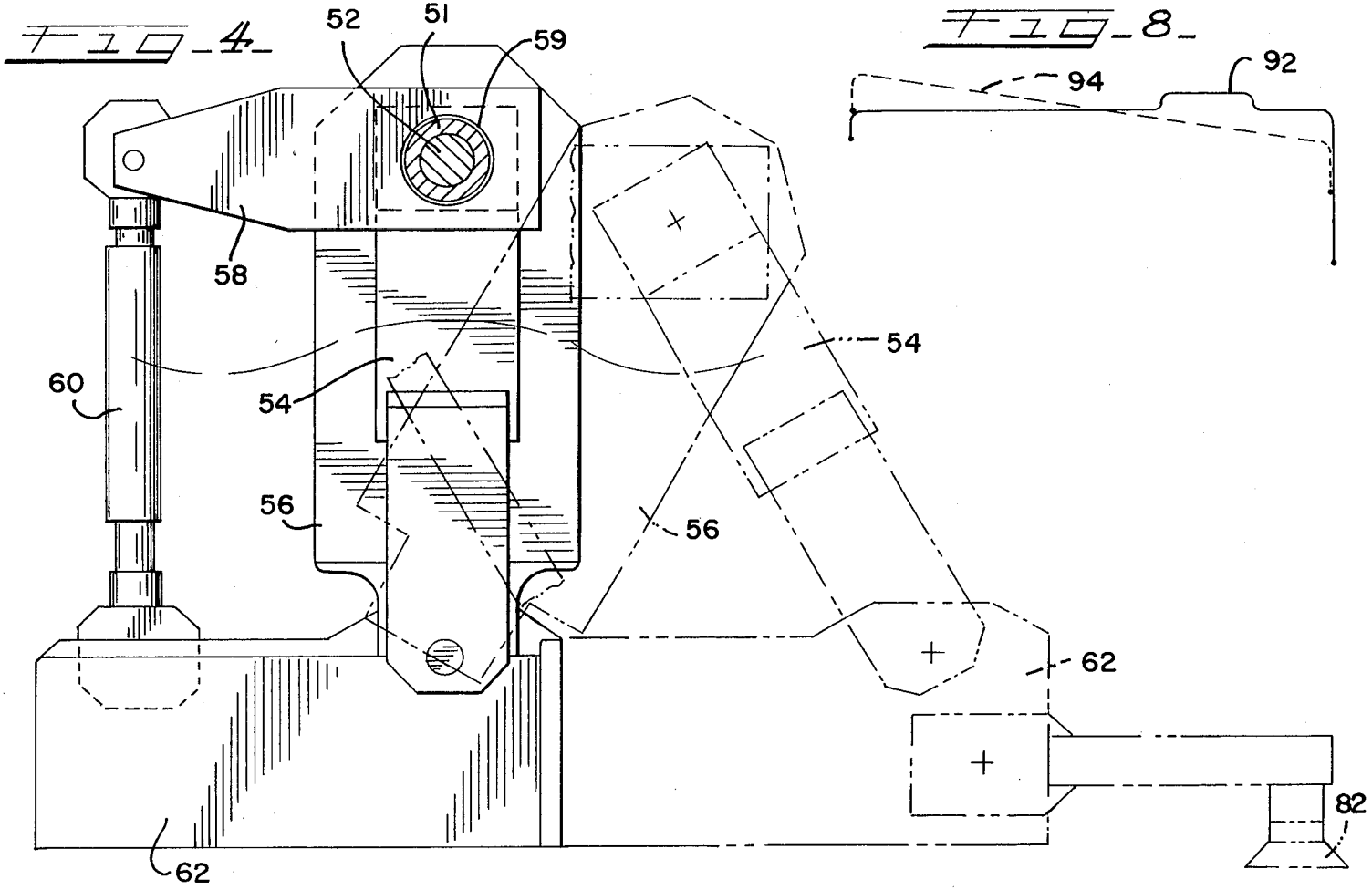
FIG. 4 is an enlarged fragmentary sectional view taken about the line 4—4 of FIG. 1, and illustrating the primary and secondary arms of the apparatus with associated gripping means.
FIG. 8 is a schematic illustration of modified paths for movement of gripping means which can be accomplished with mechanisms of this invention; and, FIG. 9 is a vertical, sectional elevation of an alternative form work piece handling apparatus of the type contemplated by this invention.

The system as illustrated in FIGS. 1–4 provides for continued positioning of the gripper support 62 in a horizontal attitude (or in some other fixed attitude, if desired). This is accomplished by means of a parallelogram arrangement including plates 58, links 60, the support 62, and the secondary arm 54. As shown in FIG. 4, the respective plates 58 are supported on bearings 59 around sleeve 51 whereby the plates are movable independently of the sleeve.

Concerning the gear trains located in the housings 12 and 13, the gears 46 and 70 of the respective gear trains are both controlled, the former by the cam follower arm 32 and the latter by being fixed to the wall of housing 13. As the arms 56 and 64 oscillate, the gear pairs 48 and 68, respectively, "walk around" the gears 46 and 70. As gears 48 "walk around" gear 46, the amount of motion of the secondary arm 54 with respect to the primary arm 56 is influenced by the ratio between gears 46 and 50. As gears 68 "walk around" gear 70, a rotationary relationship of 1:1 ratio exists with gear 66 thereby maintaining a constant horizontal position of the parallelogram plates 58. It will also be noted that the presence of auxiliary arm 64 provides additional support for the secondary arm thereby increasing rigidity and strength in the system.

Figures 5A, 5B, 5C, 6A, 6B, 6C, 7A, 7B, 7C:
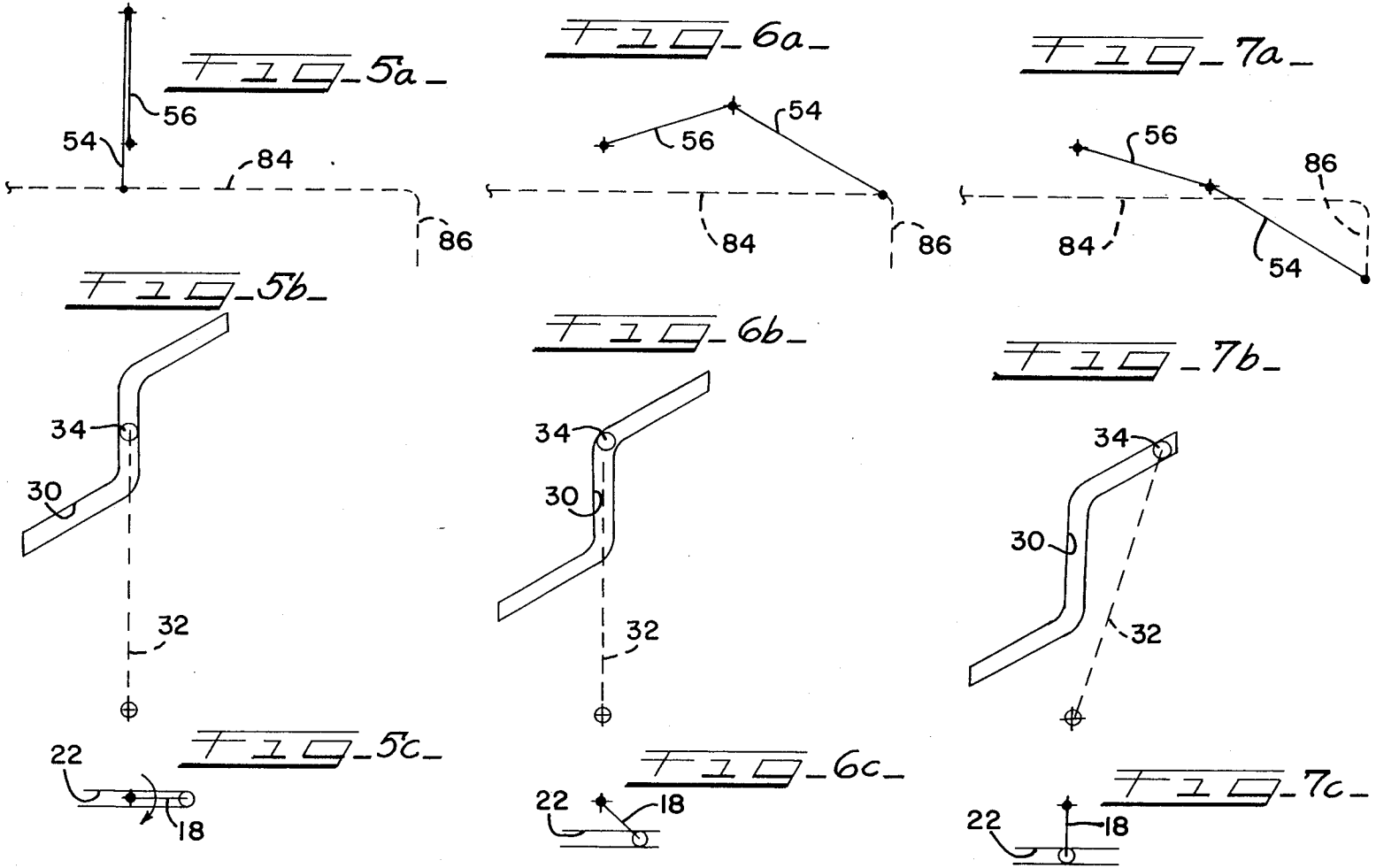
FIGS. 5*a*–5*c* comprise schematic illustrations showing the positions of apparatus mechanisms at one stage of operation.
FIGS. 6*a*–6*c* comprise schematic illustrations showing the mechanisms at a later stage of operation.
FIGS. 7*a*–7*c* comprise schematic illustrations of the mechanisms at a still later stage of operation.

The apparatus of the invention may be designed to follow a path as illustrated in FIGS. 5*a*, 6*a* and 7*a*. In FIG. 5*a*, the primary and secondary arms are shown in a vertical position with the end of the secondary arm located at approximately the center of a path of movement. This path comprises an essentially transverse portion 84 with vertical components of movement 86 being defined at each end of this transverse component. In this fashion, the work piece may be gripped by a gripper 82 at a starting position (not shown) at the left-hand side of FIG. 5*a*, moved upwardly, moved transversely toward a forming press or other work station as indicated in FIGS. 5*a* and 6*a*, and then moved downwardly onto a forming tool or the like at the work station as shown in FIG. 7*a*. A typical path of this type may have a length of 80 inches and a height of 12 inches.

The combination of FIGS. 5 through 7 more specifically illustrates the sequence of operations during one quarter turn of crank 18. In FIG. 5*c*, the crank is at the three o'clock position which places slide 24 in its intermediate position. Accordingly, the cam track 30, cam follower 34 and cam arm 32 are in the positions shown in Figure 5*b*. This places both the primary arm and the secondary arm in a vertical position as shown in FIG. 5*a*.

When the crank 18 has been driven through approximately 45° as shown in FIG. 6*c*, the slide 24 has been driven downwardly which rotates shaft 44 and pivots primary arm 56 to the position shown in FIG. 6*a*. This in turn locates the end of secondary arm 54 at about the end of transverse path portion 84, while the cam follower is now at the end of the vertical portion of cam track 30 (FIG. 6*b*).

The next 45° of movement of crank 18 (FIG. 7*c*) drives the slide 24 down to the extent that primary arm 56 has pivoted to the position shown in FIG. 7*a*. In the embodiment of the invention shown, the arm 56 is pivoted 108° from the vertical, for a total arc of 216°.

In the absence of the separate and simultaneous drive imparted to the secondary arm by the mechanisms of this invention, the secondary arm would, by the time the primary arm pivots about 90°, actually have begun to rise relative to the transverse path 84. But as shown in Figure 7*b*, the cam arm 32 has been pivoted due to the engagement of the cam follower 34 in the slanted portion of the cam path 30. This action drives the gear 46 which movement is transmitted to gear 50 and sleeve 51 so that secondary arm 54 is influenced by this drive as well as by the movement of the primary arm 56. In the embodiment shown, the interdependent drives achieve the downward portion 86 of the path of movement.

The end of the secondary arm retraces the path shown in FIGS. 5*a*, 6*a* and 7*a* during the next 90° of movement of crank 18 to the nine o'clock position. The arm end then follows a mirror image of movement on the left side of the path shown in FIG. 5*a* as the crank moves from the nine o'clock back to the three o'clock position.

It will be understood that the rotation imparted to arm 54 may be initially employed to offset the tendency of the outer end of the secondary arm to rise above its transverse path of movement. Thereafter, the cam path design imparts a downward movement to the end of the secondary arm. The result is that the invention permits a smooth transition as the path moves from the horizontal to the vertical.

It will be noted that the arm 54 is somewhat longer than the arm 56, and this is advantageous for purposes of insuring a clear path of movement for the gripper and work piece without interference from other components of the apparatus. This relationship is illustrated in FIG. 1.

The length of the arm 54 relative to the arm 56 is a factor in determining the path of movement of the end of the secondary arm. Specifically, where the secondary arm is longer, the arm end will (as discussed above) tend to depart from a transverse path of movement. In the operation of the apparatus as shown, the end does, however, tend to remain in a generally transverse path of movement for as long as the cam follower 34 is captured in the vertical portion of the cam path 30. This is achieved, for example, with a primary arm about 10 inches long and a secondary arm about 14½ inches long, and with a gear 46 of about 7½ inches in diameter and a gear 50 of about four inches in diameter.

A 1:1 ratio is maintained between the gears 70 and 66 since in the embodiment shown, these gears are intended to maintain the horizontal position of arm 62 throughout all motion of arms 56 and 54. Other drive arrangements for this arm and for the other areas in the system, including chains and sprockets, racks and pinions, etc., are contemplated.

The particular nature of the path of movement for the secondary arm may be controlled by various factors including the design of the cam surfaces, the selecting of primary and secondary arms of appropriate length, substituting link 60 with a conventional double acting pneumatic cylinder, and by the adjusting of the angle of throw for the primary arm. With such factors in mind, the configuration of the path to be followed by the gripper can be changed to suit particular needs. FIG. 8 illustrates examples of gripper path variations that can be achieved.

In addition to the variables mentioned above which enable one to provide gripper movements varying in many respects from the inverted-U movement which characterizes the embodiment illustrated, other variations in the construction shown may be employed. For example, the length of the crank 18 may be varied which will change the vertical movement of the slide and the corresponding amount of oscillating movement for the primary arm 56 thereby determining the extent of the vertical strokes. The axis of the crank may also be offset relative to the axis of the sprocket 40 for varying the proportion between the vertical movements accomplished at the opposite ends of the transverse movement. Thus, as shown in solid lines in FIG. 8, it may be desirable to provide a substantial vertical movement at one end and a smaller or no vertical movement at the other end of the gripper path, and the length of the crank plus the position of the crank axis relative to the sprocket axis can be utilized as a means for accomplishing this variation.

The portion 92 of the path shown in FIG. 8 represents the lifting of the end of the secondary arm (and associated gripper) at an intermediate stage of the movement. This may be necessary due to an obstacle in the path, or for some reason related to processing. The invention permits such a variation since the cam track or other means for controlling the attitude of cam arm 32 can be modified in numerous respects. As explained, when the arm 32 is pivoted, the gear 46 rotates and this provides an additional driving influence for the secondary arm 54.

The inclined path 94 shown in FIG. 8 may also be accomplished by modification of the cam path design. In this same connection, the slide and other apparatus components need not be aligned in the attitudes shown, and variations in path configurations may be achieved by making such changes.

Variations in the path may also be achieved by using a double arm 32, interposing between the two arms a cylinder, motor, or other power source to create an offset between the two arms. Any rotation of gear 46 thus achieved will add a driving influence to arm 54 and thereby affect the position of the end of the secondary arm. It will be appreciated in this connection that references herein to a "follower" contemplate an independent drive means operatively connected to the driver comprising, in the embodiment illustrated the slide 24.

The attitude of the gripper may be changed by providing means for adjusting gear 70 which will serve to change the positions of plates 58 on sleeve 51. For example, the plate 58 and gripper 62 could be tilted 10° from the horizontal position shown in FIG. 4, and the machine operated with these members in that attitude. This adjustment could take place before machine operation is started, or a drive means could be associated with gear 70 so that the adjustment will occur temporarily during each cycle.

The ratios of gears 46 and 50 as well as the relative lengths of arms 54 and 56 also directly effect path configurations. Similarly, the follower arm 32 may be an adjustable-length member with changes in its length changing its effect on the secondary arm movement.

It will also be noted that the tie rod 60 forming part of the parallelogram including secondary arm 54 is adapted to be adjusted lengthwise. This adjustment will change the position of the gripper relative to the secondary arm, and tilting of the gripper and other fine adjustments in the gripper operation can thus be achieved after the system has been installed. In this same connection, the rod 60 may be a pneumatic piston and cylinder which could be selectively operated during a cycle for changing the attitude of the gripper relative to the end of the secondary arm.

It is also contemplated that the drive applied to shaft 44 may be simultaneously applied to shaft 72 by means of any suitable linkage. This arrangement will achieve drive for the secondary arm on both ends of the sleeve 51 and can be advantageous, for example, where particularly heavy loads are involved.

It will be understood that the references to sprockets and gears are only intended for explanatory purposes, and these mechanisms as well as mechanical equivalents may be used interchangeably. For example, the connection between the cam follower 32 and the secondary arm is provided by means of an odd number of gears 46, 48 and 50. As will be discussed, a similar result is achieved if the gears are replaced by sprockets with a connecting chain.

The invention also contemplates the provision of limit switches associated with the worm gear connected to the drive motor 14. Such switches may be controlled by switch actuators attached to the drive shaft or to some member rotating with the drive shaft, and it will be appreciated that these switches will be actuated once during each complete cycle of gripper movement since there will be one revolution of the shaft for each such cycle. The switches may be employed, for example, to operate electromagnets associated with the gripper, for press operation, for driving gear 70 at a selected part of a cycle where that option is used, to operate a piston such as the piston 60 for tilting the gripper at selected times where the option is used, or for any other operations which are to be conducted at precise stages of an operating cycle.

Figure 9:
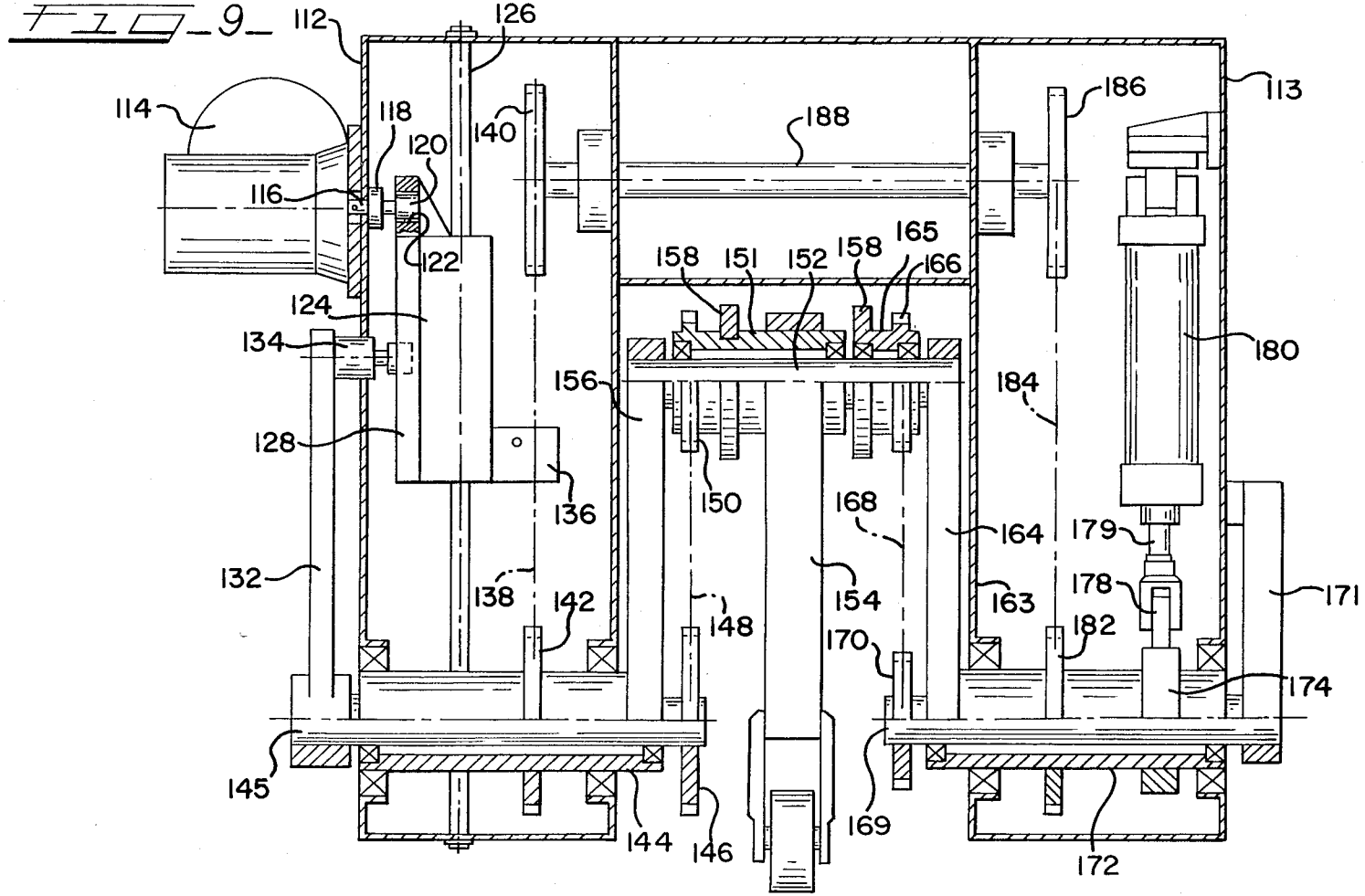

FIG. 9 illustrates an alternative form of the invention. This apparatus comprises separate housings 112 and 113 supported on a frame which may be in turn attached to a press. A drive motor 114 is positioned on a side wall of housing 112, and suitable gears connected to the motor rotate drive shaft 116. This shaft in turn operates to rotate crank 118.

Roller 120 carried at the end of the crank rides in a slot 122 defined at the upper end of a slide 124. The slide is supported on vertical rods 126, and it will be appreciated that the slide reciprocates up and down through one cycle of movement for each revolution of the crank.

Figure 2:
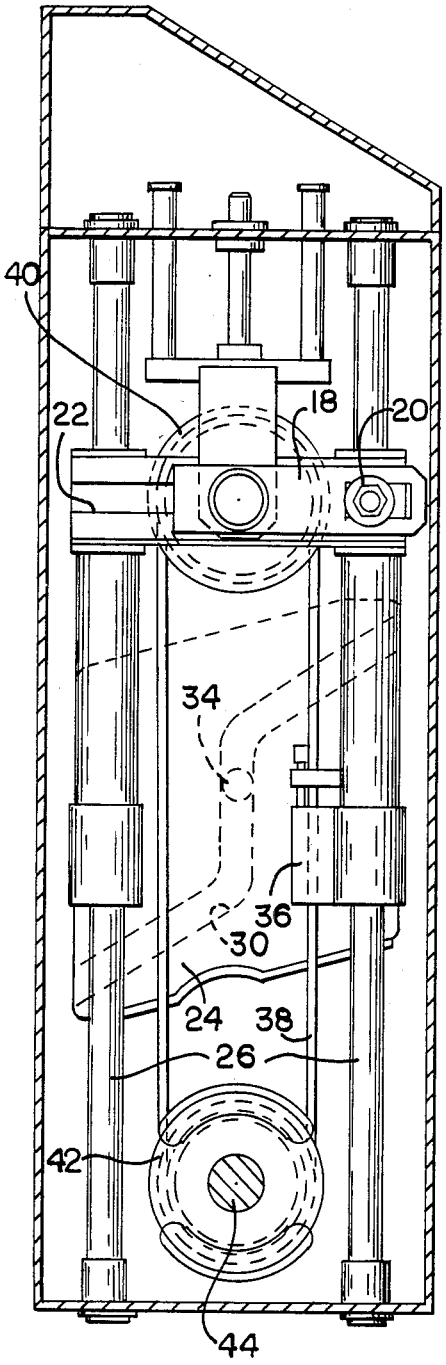
FIG. 2 is a cross-sectional view of the apparatus taken about the line 2—2 of FIG. 1.

The slide 124 carries a plate 128 which defines a cam track of the general type shown at 30 in FIG. 2. A cam follower arm 132 carries a roller 134 moveable in the cam track. As the slide 124 reciprocates up and down, and as earlier described, the cam follower is maintained in a stationary vertical position for as long as the roller 134 is received in a vertical section of the cam track. When the roller is received in an angularly disposed section of the cam track, the follower pivots to one side or the other as shown in FIG. 3.

The slide 124 also supports a clamp mechanism 136 which is clamped to the drive chain 138. This chain extends around an upper sprocket 140 and a lower sprocket 142, and the chain is driven back and forth as the slide 124 moves up and down. It will be understood that this and other references to a chain and sprocket are intended to cover all positive drive means including toothed positive drive timing belts.

The sprocket 142 is tied to sleeve 144, and this sleeve contains the shaft 145 but is not attached to this shaft. The shaft 145 is instead tied at one end to cam follower arm 132, and at its other end the sprocket 146. Sprocket 150 is connected to sprocket 146 through chain 148, and sprocket 150 is tied to sleeve 151 which is mounted on bearings around the shaft 152. The sleeve 151 is, in turn, tied to a secondary arm 154.

The sleeve 144 is tied to arm 156 which serves as the primary arm in the system. The movement of the primary arm is controlled exclusively by the sleeve 144, and this primary arm 156 therefore pivots back and forth as the sleeve 144 oscillates in response to movement of slide 124 and chain 138. The shaft 152 supporting secondary arm 154 moves back and forth as it is carried by the arm 156.

The movement of the secondary arm 154 which is influenced by the primary arm 156, is thus achieved by rotation of sleeve 144, and the relative degree of movement is controlled by the ratio of sprockets of 146 and 150. Consistent with the previously described arrangement, this ratio will generally be in the order of 2:1, with the actual ratio depending on other factos including the relative lengths of the arms. Typically, the angle which the primary arm moves in respect to a vertical line will be approximately one-half the angle of movement of the secondary arm in respect to the primary arm.

It will be noted that the shaft 152 extends beyond secondary arm 154 to an auxiliary arm 164. A separate sleeve 165 is disposed around this end of the shaft, and a sprocket 166 is mounted on this sleeve. This sprocket is connected to sprocket 170 through chain 168, the sprockets 166 and 170 having a 1:1 ratio to maintain a constant horizontal position of the parallelogram plates 158. Sprocket 170 is tied to shaft 169 and a lever 171 at the opposite end of the shaft is held relative to housing 113 whereby the shaft and sprocket 170 are normally retained against movement.

A sleeve 172 is positioned around shaft 169 and is rotatable relative to the wall 163 of housing 113. A clamp 174 is mounted on sleeve 172 and is connected to lever 178. This lever is coupled to the rod 179 of the piston of cylinder 180, and this piston and cylinder act in the system to counterbalance the weight of the moving arms and other components. The cylinder may, for example, be connected to an air supply and act as a spring which can be adjusted to develop a controlled force that balances the weight of the arms and other components.

The auxiliary arm 164 is attached to sleeve 172, and also mounted on sleeve 172 is sprocket 182 which carries chain 184. The chain extends to sprocket 186 which is mounted with sprocket 140 on common shaft 188. Accordingly, all movements of slide 124 are transmitted through shaft 188 to sleeve 172 and auxiliary arm 164. The forces applied by slide 124 are thus distributed so that movement of secondary arm 154 is simultaneously influenced by both primary arm 156 and auxiliary arm 164. Less stress on the primary arm is the result.

The arrangement of FIG. 9 provides a particularly advantageous means for controlling the attitude of the gripper independently of the influences provided by slide 124 and follower arm 132. Specifically, the lever 171 can be adjusted relative to housing 113 to shift the position of sprocket 170. This alters the position of sleeve 165 which carries the plate 158 (corresponding to plate 58 shown in FIG. 4). This change will, of course, alter the parallelogram which controls the attitude of the gripper.

The adjustment of lever 171 may be made prior to start-up, that is, the adjustment may be set with no change in lever position taking place during machine operation. Alternatively, the lever 171 may be tied to a drive means so that the adjustments are made in the course of an operating cycle as desired.

The arrangement shown in FIG. 9 will operate in accordance with the description of FIGS. 5*a* through 7*c*. Operating options as described with reference to FIGS. 1–4 are also applicable to FIG. 9.

It will be understood that various changes may be made in the invention as described without departing from the spirit of the invention particularly as defined in the following claims.

I claim:

1. In a handling apparatus having gripping means for moving work pieces along a path of movement from one location to at last one other location, the apparatus including main drive means, a primary arm driven by the drive means, and a secondary arm connected to the primary arm, said gripping means being associated with said secondary arm, the improvement wherein said drive means comprises a driver, a first support for pivotally supporting said primary arm, said driver being drivingly attached to said first support for oscillating said first support and for thereby pivoting said primary arm between first and second positions, a follower, a follower drive attachment, separate from said attachment to said first support, drivingly attaching said driver to said follower whereby movement of the driver is adapted to drive said follower, and including first and second drive connections for moving said secondary arm, said first drive connection directly connecting said secondary arm to said primary arm whereby pivoting of the primary arm moves said secondary arm and its associated gripper, and said second drive connection connecting said follower to said secondary arm whereby driving of said follower operates to drive said secondary arm and associated gripper by means of said follower drive attachment concurrently with the driving movement provided by said first drive connection whereby the combination of the first and second drive connections influences the path followed by said secondary arm and associated gripper.

2. An apparatus in accordance with claim 1 wherein said main drive means includes a drive motor and a continuously rotating crank, said driver comprising a slide adapted to reciprocate back and forth, and means operatively connecting said crank to said slide whereby said slide undergoes a complete cycle of reciprocating movement during each revolution of the crank.

3. An apparatus in accordance with claim 2 wherein said first drive connection is provided by a common shaft supporting respective ends of said arms, and including a linkage associated with said common shaft for affecting the relationship between the primary arm and secondary arm during all positions of movement of the primary arm.

4. An apparatus in accordance with claim 1 wherein said secondary arm is pivotally connected to said primary arm, and wherein the length of the secondary arm from the pivot point with said primary arm to the point of connection with said gripping means exceeds the length of said primary arm from said pivot point to the axis of said first support.

5. An apparatus in accorance with claim 1 wherein said first drive connection is provided by a common shaft supporting respective ends of said arms, and including a linkage associated with said common shaft for affecting the relationship between the primary arm and secondary arm during all positions of movement of the primary arm, an auxiliary arm supported on said common shaft on the side of said secondary arm opposite said primary arm, and including means connected to said auxiliary arm for applying a force balancing the weight of said arms and associated components.

6. An apparatus in accordance with claim 5 including independent drive means associated with said auxiliary arm, and means connecting said independent drive means to said secondary arm for further influencing the path followed by said secondary arm and associated gripper.

7. An apparatus in accordance with claim 5 including means for connecting said driver to said auxiliary arm whereby said driver drives said auxiliary arm in addition to said primary arm.

8. An apparatus in accordance with claim 5 wherein said means providing said forces comprises a piston and cylinder means connected to said auxiliary arm.

9. An apparatus in accordance with claim 5 including independent drive means associated with said auxiliary arm.

10. An apparatus in accordance with claim 9 including means connecting said independent drive means to said secondary arm for further influencing the path followed by said secondary arm and associated gripper.

11. An apparatus in accordance with claim 5 including a second support for pivotally supporting said auxiliary arm, and means connecting said driver to said second support for oscillating said second support simultaneously with the oscillating movement imparted to said first support.

12. In a handling apparatus having gripping means for moving work pieces along a path of movement from one location to at least one other location, the apparatus including main drive means, a primary arm driven by the drive means, and a secondary arm connected to the primary arm, said gripping means being associated with said secondary arm, the improvement in said drive means comprising a first support for pivotally supporting said primary arm, a driver connected to said first support for oscillating said first support and for thereby pivoting said primary arm between first and second positions, said main drive means including a drive motor and a continuously rotating crank, said driver comprising a slide adapted to reciprocate back and forth, and means operatively connecting said crank to said slide whereby said slide undergoes a complete cycle of reciprocating movement during each revolution of the crank, a follower also associated with said driver whereby movement of the driver is adapted to drive said follower, and including first and second drive connections for moving said secondary arm, said first drive connection connecting said secondary arm to said primary arm whereby pivoting of the primary arm moves said secondary arm and its associated gripper, said first drive connection being provided by a common shaft supporting respective ends of said arms, and including a linkage associated with said common shaft for affecting the relationship between the primary arm and secondary arm during all positions of movement of the primary arm, and said second drive connection connecting said follower to said secondary arm whereby driving of said follower operates to drive said secondary arm and associated gripper concurrently with the driving movement provided by said first drive connection whereby the combination of the first and second drive connections influences the path followed by said secondary arm and associated gripper, and including a sleeve surrounding said common shaft, a portion of said linkage and said secondary arm being attached to said sleeve, and wherein said second drive connection comprises means for rotating said sleeve through said linkage to thereby influence the relationship between said arms independently of the influence achieved by pivoting of said primary arm.

13. An apparatus in accordance with claim 12 wherein said linkage comprises a gear train including one gear fixed to said sleeve, and wherein said follower is connected to another gear in said train whereby movement of said follower achieves rotation of said sleeve and associated secondary arm relative to said primary arm.

14. An apparatus in accordance with claim 13 wherein said secondary arm is longer than said primary arm whereby said gripper is adapted to move without interference from other portions of the apparatus.

15. An apparatus in accordance with claim 12 including plate means extending outwardly from said sleeve and a link extending between said plate means and said gripper, the combination of said plate means, link and secondary arm controlling the attitude of said gripper.

16. An apparatus in accordance with claim 15 wherein the combination of said plate means, link, secondary arm and gripper form a parallelogram.

17. An apparatus in accordance with claim 15 including means operating independently of said first and second drive connections for adjusting the position of said plate means relative to said sleeve whereby the attitude of said gripper may be varied.

18. An apparatus in accordance with claim 17 including a second support means for pivotally supporting said auxiliary arm, and means connecting said driver to said second support means for oscillating said second support means simultaneously with the oscillating movement imparted to said first support means.

19. An apparatus in accordance with claim 18 wherein said second support means comprises a sleeve having said auxiliary arm attached thereto, a shaft extending within said sleeve rotatable with respect to said sleeve, and separate drive means extending between said last mentioned shaft and the sleeve surrounding said common shaft whereby movement of said last mentioned shaft operates to impart movement to said plate means independently of said first and second drive connections to achieve said adjustment of the position of said plate means.

20. An apparatus in accordance with claim 19 including a lever attached to said last mentioned shaft for achieving said movement of said last mentioned shaft.

21. An apparatus in accordance with claim 20 wherein said secondary arm is longer than said primary arm whereby said gripper is adapted to move without interference from other portions of the apparatus.

22. An apparatus in accordance with claim 12 wherein said linkage comprises one sprocket fixed to said sleeve, and wherein said follower is connected to another sprocket, and a chain connecting said sprockets whereby movement of said follower achieves rotation of said sleeve and associated secondary arm relative to said primary arm.

23. In a handling apparatus having gripping means for moving work pieces along a path of movement from one location to at least one other location, the apparatus including main drive means, a primary arm driven by the drive means, and a secondary arm connected to the primary arm, said gripping means being associated with said secondary arm, the improvement in said drive means comprising a first support for pivotally supporting said primary arm, a driver connected to said first support for oscillating said first support and for thereby pivoting said primary arm between first and second positions, said main drive means including a drive motor and a continuously rotating crank, said driver comprising a slide adapted to reciprocate back and forth, and means operatively connecting said crank to said slide whereby said slide undergoes a complete cycle of reciprocating movement during each revolution of the crank, a follower, a follower drive attachment, separate from said attachment of said crank to said slide, drivingly attaching said slide to said follower whereby movement of the slide is adapted to drive said follower, and including first and second drive connections for moving said secondary arm, said first drive connection directly connecting said secondary arm to said primary arm whereby pivoting of the primary arm moves said secondary arm and its associated gripper, said first drive connection being provided by a common shaft supporting respective ends of said arms, and including a linkage associated with said common shaft for affecting the relationship between the primary arm and secondary arm during all positions of movements of the primary arm, and said second drive connection connecting said follower to said secondary arm through said linkage whereby driving of said follower operates to drive said secondary arm and associated gripper concurrently with the driving movement provided by said first drive connection whereby the combination of the first and second drive connections influences the path followed by said secondary arm and associated gripper, and including an auxiliary arm supported on said common shaft on the side of said secondary arm opposite said primary arm, and including means connected to said auxiliary arm for applying a force balancing the weight of said arms and associated components.

24. An apparatus in accordance with claim 23 wherein said means providing said force comprises a piston and cylinder means connected to said auxiliary arm.

25. An apparatus in accordance with claim 23 including independent drive means associated with said auxiliary arm, and means connecting said independent drive means to said secondary arm for further influencing the path followed by said secondary arm and associated gripper.

26. An apparatus in accordance with claim 23 including means for connecting said driver to said auxiliary arm whereby said driver drives said auxiliary arm in addition to said primary arm.

27. In a handling apparatus having gripping means for moving work pieces along a path of movement from one location to at least one other location, the apparatus including main drive means, a primary arm driven by the drive means, and a secondary arm connected to the primary ram, said gripping means being associated with said secondary arm, the improvement in said drive means comprising a first support for pivotally supporting said primary arm, a driver connected to said first support for oscillating said first support and for thereby pivoting said primary arm between first and second positions, a follower, a follower drive attachment separate from said connection to said first support, drivingly attached to said driver whereby movement of the driver is adapted to drive said follower, and including first and second drive connections for moving said secondary arm, said first drive connection directly connecting said secondary arm to said primary arm whereby pivoting of the primary arm moves said secondary arm and its associated gripper, said first drive connection being provided by a common shaft supporting respective ends of said arms, and said second drive connection connecting said follower to said secondary arm whereby driving of said follower operates to drive said secondary arm and associated gripper by means of said follower drive attachment concurrently with the driving movement provided by said first drive connection whereby the combination of the first and second drive connections influences the path followed by said secondary arm and associated gripper, and including an auxiliary arm supported on said common shaft on the side of said secondary arm opposite said primary arm, and including means connected to said auxiliary arm for applying a force balancing the weight of said arms and associated components.

28. An apparatus in accordance with claim 27 wherein said means providing said force comprises a piston and cylinder means connected to said auxiliary arm.

29. An apparatus in accordance with claim 27 including independent drive means associated with said auxiliary arm, and means connecting said independent drive means to said secondary arm for further influencing the path followed by said secondary arm and associated gripper.

30. In a handling apparatus having gripping means for moving work pieces along a path of movement from one location to at least one other location, the apparatus including main drive means, a primary arm driven by the drive means, and a secondary arm connected to the primary arm, said gripping means being associated with said secondary arm, the improvement in said drive means comprising a first support for pivotally supporting said primary arm, a drive connected to said first support for oscillating said first support and for thereby pivoting said primary arm between first and second positions, a follower, a follower drive attachment separate from said connection to said first support, drivingly attached to said driver whereby movement of the driver is adapted to drive said follower, and including first and second drive connections for moving said secondary arm, said first drive connection directly connecting said secondary arm to said primary arm whereby pivoting of the primary arm moves said secondary arm and its associated gripper, said first drive connection being provided by a common shaft supporting respective ends of said arms, and including a linkage associated with said common shaft for affecting the relationship between the primary arm and secondary arm during all positions of movement of the primary arm, a sleeve surrounding said common shaft, a portion of said linkage and said secondary arm being attached to said sleeve, said second drive connection comprising means for rotating said sleeve through said linkage to thereby influence the relationship between said arms independently of the influence achieved by pivoting of said primary arm, link means connected to said sleeve, the combination of said link means and said secondary arm controlling the attitude of said gripper, and including means operating independently of said first and second drive connections for adjusting the position of said link means relative to said sleeve whereby the attitude of said gripper may be varied, and wherein said second drive connection connects said follower to said secondary arm whereby driving of said follower operates to drive said secondary arm and associated gripper by means of said follower drive attachment concurrently with the driving movement provided by said first drive connection whereby the combination of the first and second drive connections influences the path followed by said secondary arm and associated gripper.

31. An apparatus in accordance with claim 30 including an auxiliary arm supported on said common shaft on the side of said secondary arm opposite said primary arm.

32. An apparatus in accordance with claim 31 including a second support means for pivotally supporting said auxiliary arm, and means connecting said driver to said second support means for oscillating said second support means simultaneously with the oscillating movement imparted to said first support means.

33. An apparatus in accordance with claim 32 wherein said second support means comprises a sleeve having said auxiliary arm attached thereto, a shaft extending within said sleeve rotatable with respect to said sleeve, and separate drive means extending between said last mentioned shaft and the sleeve surrounding said common shaft whereby movement of said last mentioned shaft operates to impart movement to said plate means independently of said first and second drive connections to achieve said adjustment of the position of said plate means.

34. An apparatus in accordance with claim 33 including a lever attached to said last mentioned shaft for achieving said movement of said last mentioned shaft.

35. An apparatus in accordance with claim 30 wherein said secondary arm is longer than said primary arm whereby said gripper is adapted to move without interference from other portions of the apparatus.

* * * * *